US005180450A

United States Patent [19]

Rao

[11] Patent Number: 5,180,450

[45] Date of Patent: Jan. 19, 1993

[54] HIGH PERFORMANCE HIGH STRENGTH LOW ALLOY WROUGHT STEEL

[75] Inventor: Banagaru V. N. Rao, Annandale, N.J.

[73] Assignee: Ferrous Wheel Group Inc., New York, N.Y.

[21] Appl. No.: 533,574

[22] Filed: Jun. 5, 1990

[51] Int. Cl.[5] ..... C22C 38/00

[52] U.S. Cl. ..... 148/579; 148/611; 420/89; 420/91; 420/111

[58] Field of Search ..... 420/91, 89, 111; 148/134, 12 R, 12.1, 579

[56] References Cited

U.S. PATENT DOCUMENTS

| | | | |
|---|---|---|---|
| 3,368,87 | 2/1968 | Enis et al. | 420/91 |
| 3,110,798 | 11/1963 | Keay | 420/91 |
| 3,787,201 | 1/1974 | Matsukura et al. | 420/90 |
| 4,043,807 | 8/1977 | Kirman | 420/91 |
| 4,807,990 | 4/1974 | Gohda et al. | 420/91 |
| 4,855,106 | 8/1989 | Katsumata et al. | 420/110 |

FOREIGN PATENT DOCUMENTS

| | | | |
|---|---|---|---|
| 0054254 | 3/1982 | Japan | 420/110 |
| 0114551 | 6/1985 | Japan | 420/110 |

*Primary Examiner*—Upendra Roy
*Attorney, Agent, or Firm*—Mathews, Woodbridge and Collins

[57] ABSTRACT

A high strength, low alloy, low to medium carbon structural steel is provided of the Fe/Cr/C type, said steel characterized by the presence of a small but effective amount of each of Cu and Ni sufficient to enhance the mechanical stability of retained austenite formed following quenching of said steel from its austentizing temperature. Preferably the steel also includes small but effective amounts a Al, Ti and Nb suficient to provide a fine grained microstructure.

16 Claims, 5 Drawing Sheets

200X

200X

3/500X

3/500X

60000X

HIGH PERFORMANCE HIGH STRENGTH LOW ALLOY WROUGHT STEEL

BACKGROUND OF THE INVENTION

The present invention relates to a class of high performance, high strength, low alloy, low to medium carbon structural steels. High performance is defined as the ability to provide a superior property mix including high combinations of strength, hardness and toughness, together with environmental resistance, and including production flexibility and durability in field service.

STATE OF THE ART

High strength, low alloy, low to medium carbon structural steels are of particular interest because of their wide variety of uses. These steels are used extensively for components in aircraft landing gears, power transmission gears, chains, links, fasteners, shafting, armor plate, missile and rocket cases, and the like. Where such steels have high hardness accompanied by abrasion resistance, they find particular use in mining operations, such as buckets, milling equipment and other mineral processing operations.

Because of their relative high strength, such steels provide saving in weight for structural components used in bridges, ship building and automobile parts, as well as a wide variety of other uses.

Examples of commercial high strength steels include AISI 4340, such steels being referred to by the general classification of AISI 43XX. Other commercial steels also include AISI 4130, or more generally AISI 41XX.

The purpose of the present invention is to replace the foregoing types of high strength low alloy steels and to provide steels characterized by markedly improved cost/performance parameters compared to the commercial low alloy structural steels mentioned hereinabove, including SAE 8620 or, more generally 86XX.

Many of the commercial low to medium carbon (about 0.1 to 0.5 wt % C) high strength, low alloy structural steels available today with hardness in the range about Rockwell C 20 to about Rockwell C 50 provide good strength or toughness but rarely a combination of good strength and toughness. Furthermore, since most of these steels have been designed by trial and error without a sound scientific and technical basis, the history of development of these steels has been one of compromises—that is, sacrificing one property to achieve gains in some other property. For example, silicon is present in most steels as a deoxidizer which aids in the steel making process. However, its detrimental effects on mechanical behavior, especially on ductility and toughness are either ignored or not considered. Similarly, strong carbide formers such as Nb and Ti are added to achieve grain refining to benefit the strength-toughness combination. However, if the addition of these elements is not controlled judiciously, they may lead to precipitation hardening under certain tempering conditions which in turn could lead to a sudden and catastrophic loss of ductility and toughness of the steel. Virtually no commercial steel in existence today has optimized levels of grain refiners such as Nb and Ti with little or no penalty on other properties of the steel.

Structural steels in practice are not only subject to load bearing but also are exposed to various environments, often aggressive, and as such are required to possess good environmental resistance; and good load bearing capacity under the simultaneous action of load and environment for a variety of environmental conditions. Unfortunately, however, even those few structural high strength steels which have been designed based on a sound scientific basis have addressed either the mechanical properties or the environmental properties but were rarely designed to optimize both of these essential parameters for optimum engineering performance. Thus, many of the state-of-the-art steels which exhibit superior combination of strength and toughness are susceptible to stress corrosion cracking and hydrogen induced cracking.

From a practical point of view, structural steels must be designed to confer some flexibility for processing under a variety of steel mill conditions, for example, the ability to develop the desired microstructure and properties under a variety of rolling mill conditions. Also modern structural steels should be easily fabricable. For example, the steel should be weldable under a variety of welding conditions and it should have excellent weld heat-affected-zone (HAZ) toughness. These complex and varied requirements for a truly outstanding high strength low alloy structural steel for the modern world requires an integrated design approach based on a sound scientific and technical basis. The input for such an approach should include as many practical considerations and requirements as possible, such as weld HAZ toughness, tolerance for a wide variety of steel and rolling mill parameters, stress corrosion cracking resistance and resistance to hydrogen induced cracking. Thus, new steel grades are required which are designed to integrate superior mechanical properties with superior performance in other practical aspects as listed hereinabove.

The importance of designing structural steels having high strength and toughness is described in a paper entitled "Structure-Property Relations And The Design Of Fe-4Cr-C Base Structural Steels For High Strength And Toughness" by Rao and Thomas which appears in *Metallurgical Transactions A,* Volume 11A, 1980, pp. 441–457.

In this paper some design guidelines are given for improving strength-toughness combinations in medium carbon structural steels of the Fe/Cr/C type by employing Mn and/or Ni additions. These additions were used to promote improvement in toughness properties due to the formation of retained austenite and due to the fact that the addition of Ni and/or Mn tended to improve the thermal stabilization of austenite.

U.S. Pat. Nos. 4,170,497 and 4,170,499 issued to the aforementioned authors describe a structural steel with superior strength-toughness combinations. This steel is based on developing a composite microstructure of dislocated, auto-tempered lath martensite surrounded by films of untransformed austenite, that is, retained austenite. While these patents describe in broad terms the desirable microstructural features from a purely mechanical property point of view, the optimization of these microstructural features for the best combination of mechanical properties is not considered. Most importantly, other practical requirements including the environmental resistance aspects (such as stress corrosion cracking resistance (SCC), hydrogen induced cracking resistance) and processing and fabricability aspects are not considered. These patents describe high strength, tough alloy steels consisting essentially of from about 0.20 to about 0.35 weight % carbon, about 3.0 to 4.5 weight % chromium, and at least 1 weight % of at least one other substitutional alloying element selected from the group consisting of nickel, manganese, molybdenum, cobalt, silicon, aluminum and mixtures thereof, and the remainder iron. These patents also describe complex double heat-treatments to produce grain refining and the desired microstructure within these grains. In U.S. Pat. No. 4,671,827 an alternate controlled rolling procedure is described which requires the use of certain rolling mill sophistication to induce fine grain structure.

It would be desirable to provide a low alloy, low to medium carbon steel of the Fe/Cr/C variety containing a novel combination of alloying constituents capable of optimizing the microstructural characteristics of the steel without requiring the use of complex heat treatments or complex working operations.

OBJECTS OF THE INVENTION

It is thus an object of the invention to provide a low alloy, low to medium carbon structural steel composition of the Fe/Cr/C type containing a novel combination of alloying constituents and characterized by optimum combination of mechanical properties.

Another object of the invention is to provide a low alloy, low to medium carbon structural steel of the Fe/Cr/C type containing a novel combination of alloying constituents sufficient to enhance the mechanical stability of retained austenite formed in said steel.

A further object of the invention is to provide as an article of manufacture a heat treated steel component of the Fe/Cr/C type characterized by a hardness of at least about 25 $R_C$, a fine grained microstructure consisting essentially of lath martensite enveloped by a thin film of retained austenite, said austenite being further characterized by enhanced mechanical stability.

A still further object of the invention is to provide a low alloy, low to medium carbon structural wrought steel composition of the Fe/Cr/C type containing controlled amounts of carbon, nickel, copper, niobium, titanium and aluminum, said steel composition characterized in the heat treated state by optimum hardness, optimum combination of mechanical properties, and thermally stable retained austenite and very fine grain size.

An additional object is to provide a method for producing a wrought low alloy, low to medium carbon structural steel of the Fe/Cr/C type characterized by an improved combination of mechanical properties, optimum hardness, impact toughness and plane strain fracture toughness ($K_{1C}$ expressed as KSi-in$^{\frac{1}{2}}$).

These and other objects, features and advantages will become more apparent when considered in conjunction with the accompanying disclosure, claims, and appended drawings.

THE DRAWING

STATEMENT OF THE INVENTION

Figure 1A:
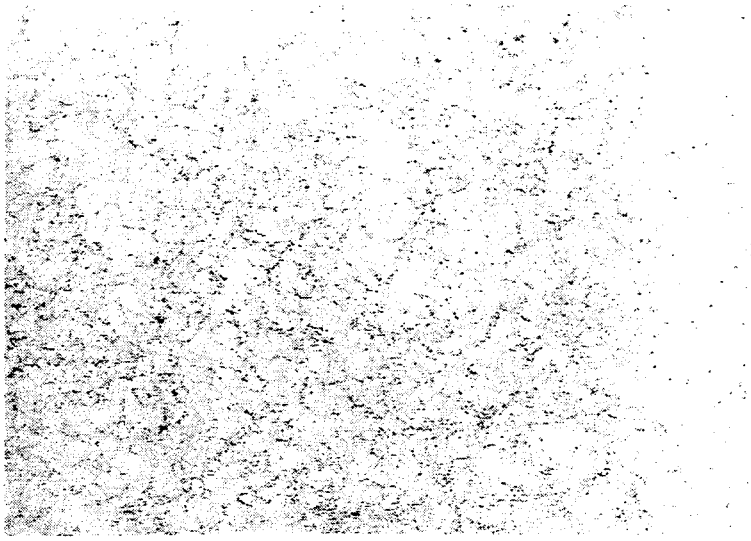
FIG. 1A is a reproduction of a photomicrograph taken at 200 times magnification of the steel of the invention showing a fine as—forged grain size of substantial uniformity.

One embodiment of the invention resides in a method for enhancing the mechanical stability of retained austenite of high strength, low alloy, low to medium carbon steel of the Fe/Cr/C type, said method comprising adding a small but effective amount of both copper and nickel to said steel composition.

Another embodiment of the invention is directed to a high strength, low alloy, low to medium carbon steel of the aforementioned Fe/Cr/C low alloy steel containing said copper and nickel.

Such steels include the composition by weight of about 0.5 to 4% Cr and about 0.05–0.5% C, said steel also containing small but effective amounts of about 0.1 to 2% Cu and of about 0.1 to 3% Ni at least sufficient to enhance the mechanical stability of retained austenite.

A further embodiment of the invention resides in a method of producing fine grained low alloy, low to medium carbon steel consisting essentially of an Fe/Cr/C/Cu/Ni steel to which small but effective amounts of Al, Ti and Nb are added sufficient to provide fine grained steel following rapid cooling from the austenitizing temperature without requiring controlled hot working operations and complex heat treatments to produce said fine grains.

A still further embodiment of the invention is directed to a fine grained high strength low alloy, low to medium carbon steel consisting essentially of Fe/Cr/C/Mn/Cu/Ni/Al/Ti/Nb.

DETAILED DESCRIPTION OF THE INVENTION

In accordance with a preferred embodiment of the invention, a class of high strength, high toughness low alloy steels of specified composition, cleanliness and microstructure are produced to integrate their mechanical property superiority with processing and fabrication advantages, the steels being characterized, in addition, with a set of unique engineering property and practical performance advantages. The preferred compositions of the steels consist of principal alloying elements, microalloying, grain refining/weld HAZ toughness improvement additives and are fabricated to certain cleanliness standards by controlling the amount of residuals. The principal alloying elements include about 0.05 to 0.5 weight % carbon, about 0.5 to 4 weight percent chromium, and about 0.5 to 2 weight % manganese.

The preferred microalloying ingredients include copper and, more preferably, combined additions of copper and nickel for enhancing the stability of retained austenite. The preferred ranges for copper and nickel are about 0.1 to 2.0 weight % and about 0.1 to 3.0 weight %, respectively. The grain refining/weld HAZ toughness improvement additions include at least two and preferably all three combined additions of the following elements: niobium, titanium and aluminum.

The preferred ranges for these elements are as follows: niobium, about 0.005 to 0.03 weight %; titanium, about 0.005 to 0.02 weight % and aluminum, about 0.01 to 0.05 weight %. In addition to these preferred ranges, the steels of the present invention require strict control as to cleanliness, level of residuals, and other undesirable alloying additions that are common in steel melting practice. For example, the steels of the present invention require that maximum limits be placed on the following more common residual elements in order that these steels develop the desirable microstructure and properties: sulfur levels not to exceed about 0.012 weight %, phosphorus levels not exceed about 0.015 weight %, silicon levels be maintained as low as possible but not to exceed about 0.1 weight % and soluble nitrogen not exceeding 150 weight parts per million (ppm), but more preferably not exceeding 75 weight ppm.

Examples of preferred ranges of composition for the steels of the present invention are tabulated in weight % in Table I. Within these preferred ranges, specific steels can be designed to obtain certain combination of mechanical properties or other engineering and technological properties. Specifically, for a steel designed to have superior strength and toughness combinations compared to those of AISI 4340 and 4130, the preferred embodiments of steel chemistry are tabulated in weight % in Table II.

TABLE I

CHEMISTRY RANGE FOR STEELS OF PRESENT INVENTION

| | Range |
|---|---|
| Principal Alloying Elements | |
| C | 0.05–0.50 |
| Mn | 0.5–2.0 |
| Cr | 1.0–4.0 |
| Microalloying | |
| Cu | 0.1–2.0 |
| Ni | 0.1–3.0 |
| Grain Refining/HAZ Toughness Improvement | |
| Nb | 0.005–0.03 |
| Ti | 0.005–0.02 |
| Al | 0.01–0.05 |
| Residuals | |
| S | <0.012 |
| P | <0.015 |
| Si | <0.1 |
| N | <150 ppm |

TABLE II

EXAMPLE OF PREFERRED CHEMISTRY OF STEEL FOR PERFORMANCE EXCEEDING THAT OF AISI 43XX, AISI 41XX AND SAE 86XX STEELS

| | Range |
|---|---|
| Principal Alloying Elements | |
| C | 0.20/0.30 |
| Mn | 1.5 |
| Cr | 1.8/2.0 |
| Microalloying | |

TABLE II-continued

EXAMPLE OF PREFERRED CHEMISTRY OF STEEL FOR PERFORMANCE EXCEEDING THAT OF AISI 43XX, AISI 41XX AND SAE 86XX STEELS

| | Range |
|---|---|
| Cu | 0.3/0.4 |
| Ni | 0.2 |
| Grain Refining/HAZ Toughness Improvement | |
| Nb | 0.015 |
| Ti | 0.015 |
| Al | 0.02 |
| Residuals | |
| S | <0.01 |
| P | <0.012 |
| Si | <0.1 |
| N | <150 ppm |

Another preferred steel composition is one that ranges from about 0.2 to 0.25% C, about 1.4 to 1.6% Mn, about 1.8 to 2.4% Cr, about 0.25 to 0.5% Cu, about 0.2 to 0.5% Ni, about 0.01 to 0.05% Al, about 0.005 to 0.02% Ti, about 0.01 to 0.03% Nb, less than about 0.005 to 0.015% P, less than about 0.001 to 0.01% S, less than about 0.1% Si, less than about 150 ppm N and the balance essentially iron.

It would be helpful at this point to explain certain terms applicable to austenite and its transformation characteristics. Those familiar with the field have used a variety of technical terms to describe the transformation characteristics of austenite. Insofar as the present invention is concerned, the following technical terms will be used.

Stabilization of austenite refers to the processes and mechanisms responsible for retaining the high temperature austenite phase in the metastable condition at ambient. Stability of austenite is that property of retained austenite to transform when subjected to thermal ageing and/or mechanical deformation.

In the context of the above terminology, thermal stabilization refers to thermal processes, seen as carbon and nitrogen diffusion and precipitation effects, which lead to the retention of austenite when quenched from a high temperature.

Mechanical Stabilization refers to the retention of austenite during quenching from a high temperature to accommodate volume expansion which occurs when a major portion of austenite transforms to martensite.

Thermal Stability refers to the stability of retained austenite to transformation when subjected to thermal ageing. Mechanical Stability refers to the stability of retained austenite to transformation when subjected to mechanical deformation.

In achieving the desired hardness and toughness in the steel of the invention, the steel is quenched from an austenitizing temperature ranging from about 870° C. to 1150° C., preferably about 900° C. to 1100° C. Following the quench, the steel may be tempered at a temperature ranging from about 170° C. to 250° C., preferably from about 190° C. to 230° C. in accordance with known procedure.

A major feature of the invention is the use of a four pronged approach to impart unique microstructure and cleanliness to the steel: first establish a frame work of fine prior austenite grain structure, with average grain diameter below about 50 microns, preferably below about 25 microns or ASTM grain size number in the range 8 to 11. Having achieved the fine grain size, the second part of the four pronged approach is to install a microcomposite microstructure within these grains consisting of the major phase comprising dislocated lath martensite enveloped by a minor phase of retained austenite of optimized mechanical stability. The third part is concerned with the judicious control of unwanted tramp elements in the steel and the overall cleanliness of the steel in terms of the inclusion control. A fourth distinguishing feature of the current invention is the minor alloying additions to impart some special processing and engineering properties to the steel while not adversely affecting the other three aspects discussed above. The four aspects mentioned above are dramatic and significant and provide a total integrated concept which results in a unique class of high strength and tough structural steels. These four aspects of the present invention will be discussed in detail below.

(I) Grain Size Control

A key aspect of the composition of the steels of the current invention is the ability of the steel to develop and maintain ultrafine austenite grain sizes of about 50 micrometers or less, for a variety of rolling mill and forging mill on-line and off-line processing conditions. A major feature of the invention is the realization that a well controlled addition of mixtures of niobium and titanium microalloyed together with control of aluminum and nitrogen enable the accomplishment of this goal. The steels of the present invention are designed to fully exploit the benefits of minor co-additions of niobium and titanium to make the steels much more forgiving for process variability than comparable steels in the same class, including the single niobium added steels, and yet have the ability to develop ultrafine grain sizes. A key finding of the invention is that the amount of niobium-titanium coadditions is controlled, so that the total addition preferably does not exceed 0.05 weight %. More importantly, the individual amounts of these elements should also be controlled; that is, titanium addition should not exceed about 0.02 weight % and the niobium addition should not exceed about 0.03 weight %.

It has been found that with these upper limits on niobium/titanium, their primary purpose of achieving the grain refining and other processing flexibility as described below is attained while avoiding the drawbacks of such additions on precipitation hardening and the consequent severe loss of matrix toughness. Moreover, at these levels, it has been discovered that the grain coarsening in the weld heat-affected-zone (HAZ) is substantially reduced which has a very positive effect on weld HAZ toughness, especially for high heat input welding. At the same time, the amount of detrimental formation of the high carbon (greater than about 0.6% by weight) martensite-austenite constituent, which severely degrades the toughness of local regions of the weld HAZ, is avoided in the intercritical/subcritical and intercritically reheated regions of the weld HAZ; these being the two most sensitive regions for the formation of this constituent.

This is but one example of the unique approach used in the alloy design of the current class of structural steels, that is, taking advantage of the beneficial attributes of the addition of niobium and titanium, while at the same time, minimizing or eliminating the detrimental side effects of these additions by employing an integrated design philosophy which is dependent upon judiciously controlling these additions using a firm scientific and technical approach. The co-additions of niobium and titanium in the specified amounts also lead to substantial processing flexibility for the following reasons:

The niobium-titanium treated steels have minimal tendency for grain coarsening even at very high temperatures, as high as 1250 degrees Celsius. This allows flexibility to use relatively high ingot and billet soaking and rolling/forging temperatures which in turn allow for the use of large rolling/forging pass reductions per pass even with old rolling/forging mill facilities having limited rolling force and torque capabilities. The use of large rolling/forging pass reduction is extremely desirable for two main reasons: 1) it results in markedly enhanced nucleation rate for recrystallized austenite grains which leads to much finer and more uniform austenite grain structure in the as rolled/forged products; and 2) the use of large per pass reductions is also beneficial in promoting uniform recrystallized grain structure for thick sections. Moreover, niobium-titanium additions help to stabilize the recrystallized grain structure during the hold period, such that after the finish rolling/forging operation, significant grain coarsening is avoided, thereby adding to processing flexibility.

One of the key advantages of the current invention is that inducement of fine grain size does not require the use of sophisticated controlled rolling/forging practices. In fact, austenite grain sizes in the range 10 to 15 micrometers diameter (ASTM grain size numbers in the range 8 to 11) may easily be obtained by a simple austenitizing treatment in the temperature range of about 87020 to 1000° C. This simple treatment can be performed off-line thereby providing significant processing flexibility to induce fine grain structure in situations where a particular rolling/forging mill does not have facilities to do on-line heat-treatment (quenching). Furthermore, in many instances, it may be desirable to provide steel in a softened as-rolled/forged condition which would require that the steel not be quenched on-line. This is because in many applications, the steel is worked in its softer condition to fabricate different engineering shapes or components. Thereafter, the steel's hardness and microstructure can be restored by a final off-line heat-treatment.

Figure 1B:
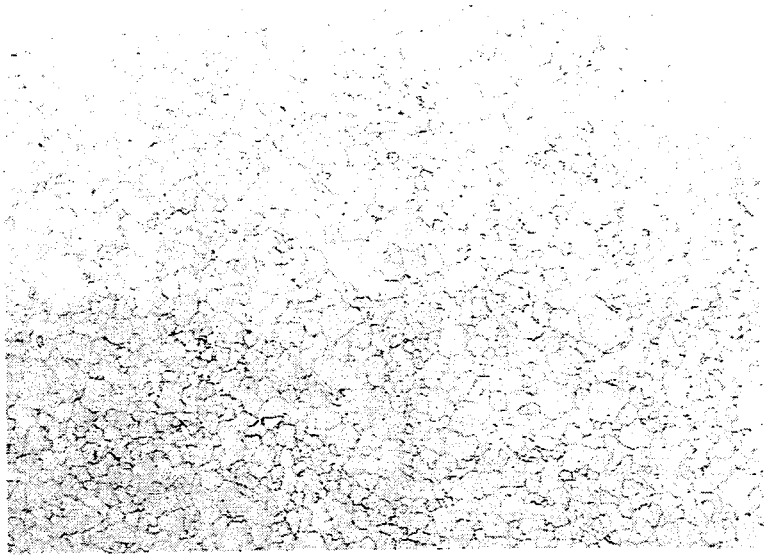
FIG. 1B is similar to FIG. 1A but differs in that it shows the steel at 200 times magnification in the as quenched condition following heating of the steel at the austenitizing temperature of 900° C. for 45 minutes.

The steels of present invention are capable of developing fine austenite grain structures for the foregoing specific situation. Those steels that depend on sophisticated on-line controlled rolling/forging practices are not able to provide fine grain structures during an off-line final heat-treatment after fabrication into shapes. Examples of fine grain structures in two conditions, are shown, for example, in the forged condition (FIG. 1A) and in the off-line heat-treated condition illustrated in FIG. 1B. The steel contains by weight 0.21% C, 1.55% Mn, 1.93% Cr, 0.26% Ni, 0.32% Cu, 0.027% Al, 0.012% Ti, 0.02% Nb, 0.012% P, 0.004% S, 0.10% Si, about 125 ppm N and the balance essentially iron and has a grain size in the range ASTM 9 to 11.

Grain refining in the presence of combined titanium-niobium additions is primarily achieved by the precipitation of grain pinning, thermally highly stable titanium, niobium carbo-nitride Ti, Nb (C,N) particles. These particles are most effective if they are uniformly precipitated during solidification of the ingot from the melt in sizes preferable less than a micrometer or micron in their longest dimension. The secondary grain refining particles in the steels of the present invention are aluminum nitrides and oxides.

(II) Microcomposite Microstructure

The steels of the present invention are designed to develop, upon quenching (or fast cooling) from a suitably high austenitizing temperature, a microcomposite microstructure consisting of soft and tough retained austenite films surrounding strong lath martensite. U.S. Pat. Nos. 4,170,497 and 4,170,499 disclose such structures to be very desirable to provide high strength and toughness. U.S. Pat. No. 4,170,499 discloses a method of making a high strength, tough alloy steel having a fine grained structure with the duplex microstructure as described in U.S. Pat. No. 4,170,497. The method of making high strength, tough alloy steel as disclosed in these patents require the use of complex thermal treatments which are inefficient and costly.

U.S. Pat. No. 4,671,827 discloses a process of controlled rolling and controlled cooling to produce fine grain structure during on-line processing. However, most existing mills are not capable of implementing the stringent rolling pass reductions and cooling disclosed in this patent. Furthermore, as already mentioned, it is desirable in many instances not to produce the desired grain structure-microstructure during on-line processing but rather during a subsequent heat-treatment after fabrication of the intermediate and final engineering components. Thus, the methods of prior art have serious limitations in their practical applicability. What is truly required is a steel that is forgiving and has the flexibility to respond to a variety of on-line and off-line heat-treatment conditions to give the desired grain structure-microstructure combinations. The steels of the present invention provide this flexibility.

As previously mentioned, the steels of the present invention are capable of producing a fine austenite grain structure with the desired microstructure with a simple heat-treatment in the 870° to 1150° C. range for about 45 minutes to 60 minutes followed by rapid quenching to ambient, for example, in water. This heat-treatment can be performed at the final stage after fabrication of an engineering component. Thus, the raw material steel can be supplied in a softer, hot forged or as rolled condition as it comes off the rolling/forging line for ease of workability and fabrication into complex engineering shapes.

Alternately, the steels of the present invention are particularly capable of developing extremely fine grain structures during controlled rolling/forging operations. What is remarkable about the steels of the present invention is the ability of the steel to develop fine grain structure even with sophisticated controlled rolling-/forging or semi-sophisticated controlled rolling/forging, and including a variety of finish rolling/forging temperatures with finishing temperatures as high as 1100° C. Furthermore, the steels of the present invention can be quenched on-line to induce the formation of the microcomposite microstructure within the grains. Alternatively, the steels can be reheated on a separate line in the high temperature austenite region in the temperature range of about 870° to 1150° C. and then quenched rapidly to ambient to produce the desired grain structure-microstructure combinations. This processing flexibility is quite important a many rolling-/forging mills across the world do not have sophisticated rolling/forging lines or facilities for on-line quenching. The installation of these facilities involves significant capital outlays and many steel mills are reluctant to install such facilities. The results achieved with the present invention show that the control of the individual and combined amounts of titanium, niobium and aluminum together with the other alloying elements set forth in Tables I and II is necessary to provide the processing flexibility discussed hereinabove.

In the course of the present discovery, it has been found that the properties of the microcomposite microstructure comprising the retained austenite films at the dislocated lath martensite boundaries are particularly dependent on and are optimized by suitable control of the amount and stability of the retained austenite and the amount of transformation thereof by mechanical stress or strain. Austenite in these steels is a metastable phase and is retained at ambient conditions due to the interplay between complex stabilization mechanisms, including chemical, thermal and mechanical stabilization factors. The amount of austenite retained during on-line or off-line heat-treatments is very sensitive to the chemistry of steel and the heat-treatment itself. Once retained at ambient, the austenite is metastable and can decompose when exposed to mechanical stress/-strain or when subject to thermal exposure of temperatures above about 180° C. The nature of the decomposition of this retained austenite profoundly affects the mechanical and environmental properties of the steels.

It has been found that excessive amounts of retained austenite are detrimental to yield strength of the steel and may lower the overall strength-toughness combinations. Thus, about 1 to 10 volume percent and, more preferably, between about 2 to 4 volume percent of retained austenite, is ideal for excellent combinations of strength and toughness. Chromium in the preferred range of about 1.5 to 2.5 weight % and manganese in the range of about 0.8 to 1.8 weight % are shown to establish the desired volume fractions of retained austenite without affecting the desirable dislocated lath martensitic structure which forms the major phase of the microstructure and acts as the load bearing constituent and provides excellent strength. However, the austenite so generated in the steel with controlled chromium and manganese has been found to have inadequate stability when exposed to mechanical stress/strain leading to premature decomposition in the stress/strain field, for example, in the plastic zone ahead of a running crack. When the austenite transforms prematurely, its crack blunting ability is lost and the toughness benefit due to the existence of this phase in the microstructure is not optimized. However, if the austenite is overly stable, then again the benefits associated with Transformation Induced Plasticity (TRIP) are not achieved resulting in an overall reduction in the achievable toughness of the steel. These aspects are important not only for the case of straight mechanical stress/strain but also for the combined action of mechanical stress/strain and environment. In the prior art, the full implications of an unoptimized austenite phase in the microstructure on the mechanical properties of the steel in both the presence and absence of an environment are not recognized and addressed in low alloy steels (especially in steels where the total weight percent of alloying elements does not exceed about 6% and preferably not exceed about 5 weight %). Attempts have been made to modify the stability of the austenite phase by excessive additions of expensive nickel in amounts greater than about 1 weight % and in a preferred embodiment about 3 to 5 weight %. While this amount of nickel is conducive to the retention of austenite, it also tends to overstabilize the austenite to mechanical stress/strain, thereby leading to less than optimum combinations of strength and toughness.

Thus, in carrying out the invention, it has been found that controlled additions in the range of about 0.1 to 2.0 weight % and more preferably in the range of about 0.25 to 0.6 weight % copper produce the desired optimum stability of retained austenite during mechanical stressing/straining both in the presence of as well as in the absence of the environment. This small but essential addition of copper to steel has been found to postpone the stress/strain induced transformation of retained austenite to greater strains/stresses than is the case in steels without essential amounts of copper. For example, in an uniaxial tensile test, the onset of transformation of the austenite is observed at or beyond the start of plastic instability (necking) in copper bearing steels whereas in steels without copper, such transformation takes place prematurely at the onset of yielding. This effect in turn leads to maximization of the beneficial effect of retained austenite on the toughness properties of the steel.

Figure 2A:
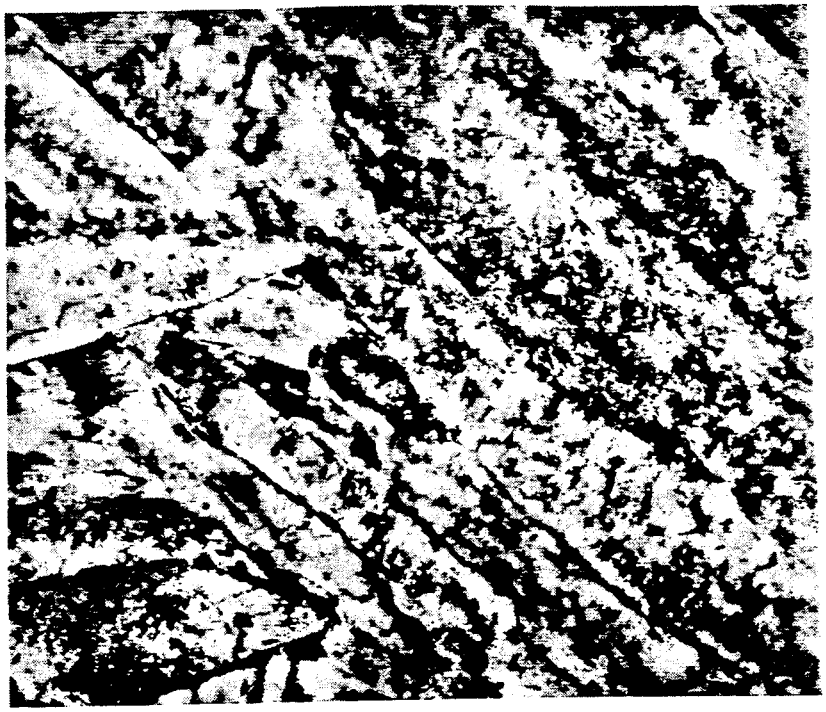
FIG. 2A is a reproduction of a photomicrograph of the steel of the invention taken by transmission electron microscope at 31,500 times magnification under bright-field conditions showing lath martensite obtained by heating the steel at 1000° C. for 45 minutes, rapidly quenched in water, and tempered at 200° C. for 60 minutes.
Figure 2B:
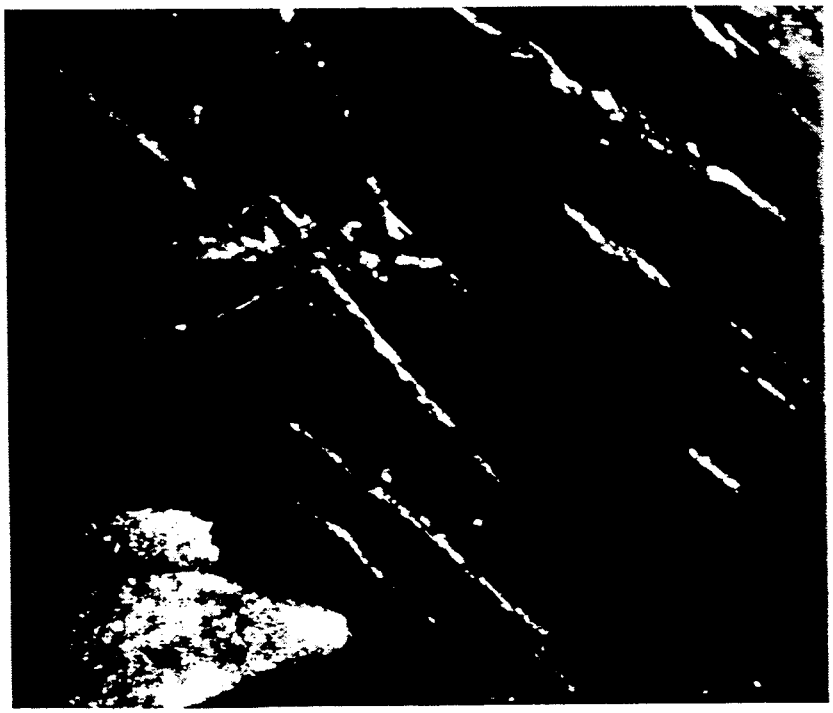
FIG. 2B is the same as FIG. 2A, except that the photomicrograph was obtained under dark-field conditions to show retained austenite disposed between lath martensite.
Figure 3:
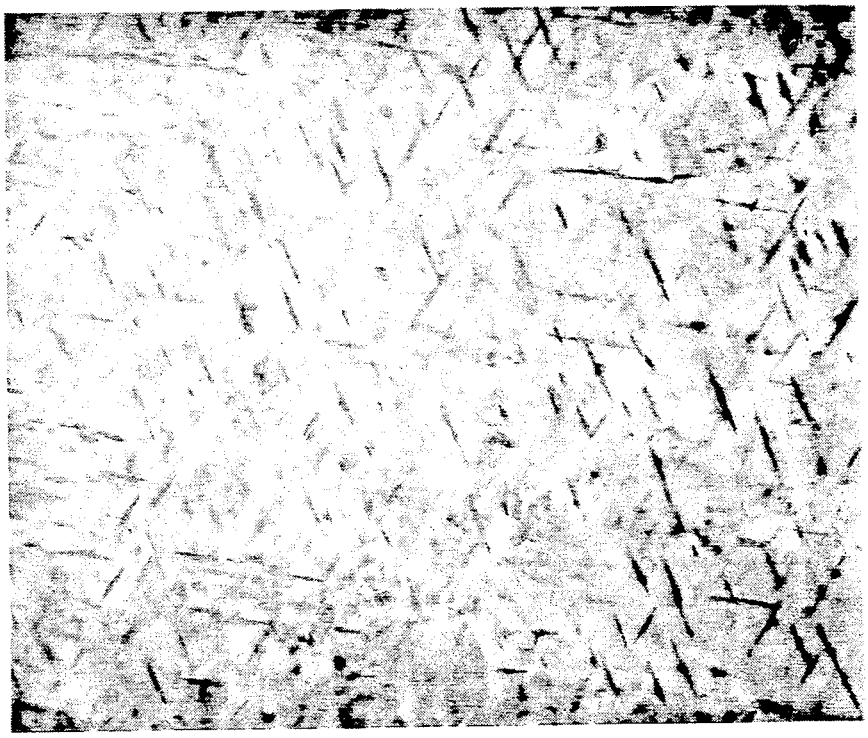
FIG. 3 is a reproduction of a photomicrograph of the steel of the invention taken by transmission electron microscope at 60,000 times magnification, the steel having been heat treated by austenitization at a temperature of 1000° C. for 45 minutes, rapidly quenched in water, and thereafter tempered at 200° C. for 60 minutes to show interlath fine carbide particles.
Figure 4:
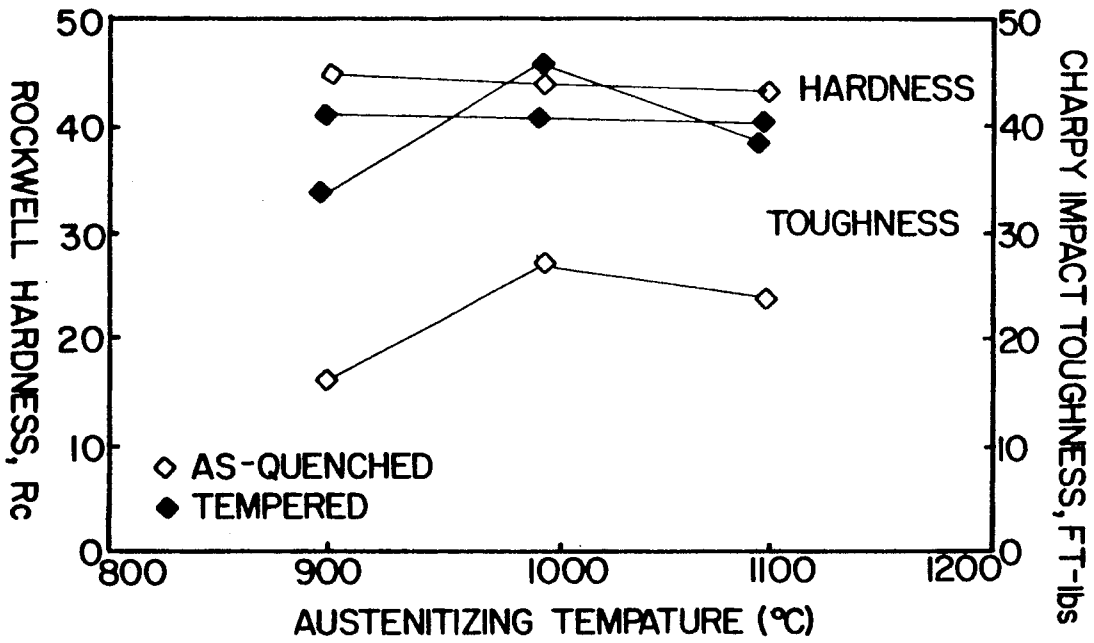
FIG. 4 is a graph showing the effect of the austenitizing temperature on the mechanical properties of the steel of the invention.
Figure 5:
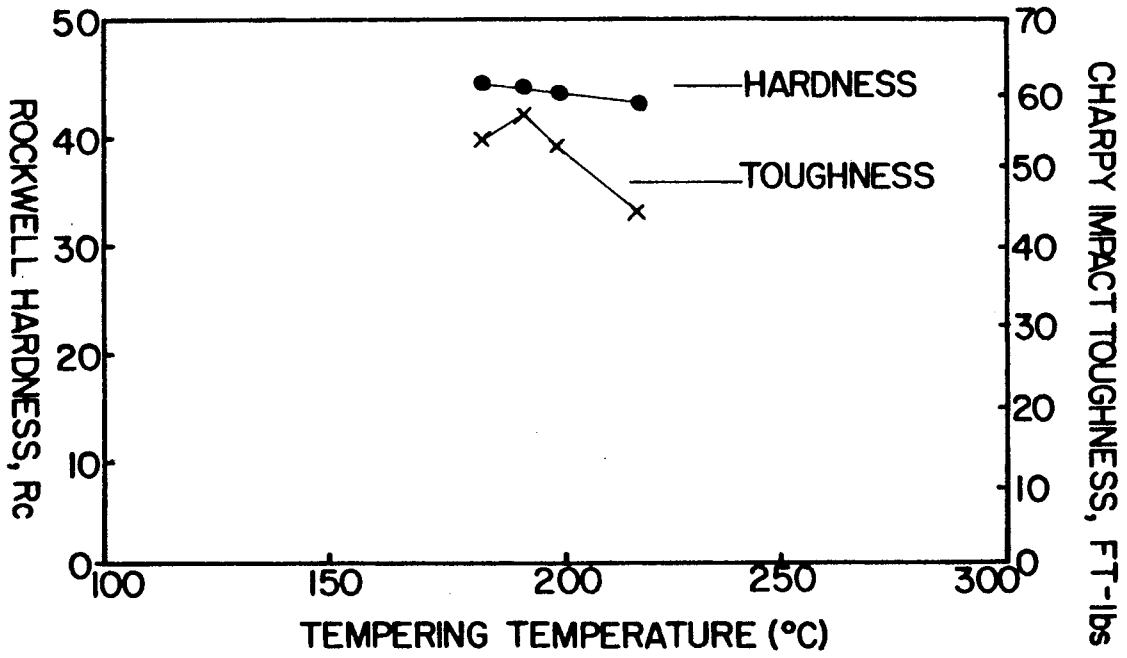
FIG. 5 is a graph showing the effect of tempering temperature on the mechanical properties of the invention.

What is also important is the observation that judicious copper additions are found to accomplish these desired effects on the minor phase, vis-a-vis, retained austenite, without any adverse effects on the major phase of the microstructure, vis-a-vis, dislocated lath martensite. Copper additions at the specified limits have been found to maintain the dislocated substructure of the base martensite without any indication of the presence of detrimental substructural twinning. FIGS. 2A and 2B illustrate the ideal microstructure obtained in the steels of the present invention containing copper.

It is well known by those skilled in the art that copper, even in small amounts, leads to "hot shortness", a phenomenon associated with formation of low melting phases in copper bearing steels. For this reason, a small amount of nickel is added with copper to overcome this adverse phenomenon. Thus, the steels of the present invention are modified with judicious amounts of nickel. The amount of nickel is controlled and optimized so that the steels do not suffer the overstabilization of austenite as has been the case with some of the steels of prior art. The amount of nickel for one of the preferred embodiments is shown in Table II. At these low levels of nickel, it has been found that not only is the deleterious effects of copper on hot shortness of steel obviated, but they also contribute to the low temperature toughness of the steel, that is, particularly by lowering the ductile to brittle transition temperature.

(III) Impurity and Inclusion Control

While the mechanical and environmental properties of steel are dependent on its grain size and microstructure, impurities and inclusions introduced during the steel making process also can degrade its properties. With this in mind, steels of the present invention are designed with acceptable upper limits of tramp impurities which may dissolve in the steel or may precipitate in the form of damaging inclusions. Silicon, although a common alloying element in most commercial structural steels, is an unwanted impurity for the steels of the present invention. Silicon is present in most commercial steels as a deoxidizer and an economical strengthener of steel. However, silicon can produce adverse affects from the point of view of the desired microcomposite microstructure of the present steels. In particular, it has been found that small amounts of silicon adversely affect and decrease the stability of retained austenite to mechanical stress/strain. This leads to premature decomposition of the austenite and consequently the degradation of the achievable property limits in the steel. Furthermore, silicon while strengthening the major martensite phase actually results in rather substantial decrease in the flow, ductility and toughness of this phase with the net result that the increased increment in strength is obtained at a rather steep price in toughness. An interesting aspect of the present invention is that silicon is not only harmful to the toughness of the base steel but also is even more detrimental to the toughness of the weld heat-affected-zone (HAZ) where it promotes the formation of embrittling microstructures resulting from the complex thermal cycles of the multipass welding. This subject is discussed in more detail later. Due to the above observations, the steels of the present invention are fabricated with as little silicon as practicable but preferably with an upper limit of 0.1 weight %. This requirement is particularly applicable to wrought products in which silicon is not necessary.

The other important tramp elements in steel are sulfur and phosphorus. Generally, these elements are precipitated out during steel solidification and ingot casting in the form of inclusions. These inclusions can lower the impact upper-shelf energy and increase the ductile-to-brittle transition temperature. Both of these effects are detrimental to steel toughness. Moreover, sulfide inclusions can lead to lamellar tearing during welding and hence can create some serious practical problems. Also, the formation of sulfide inclusions in these steels ties up valuable manganese therewithin which could have otherwise been available for the development of the desired microcomposite microstructure. Phosphorus that is not precipitated out and present in the dissolved state in steel has the same detrimental effects as described above with silicon. Because of the negative effects of these elements, they should be maintained as low as possible in the steel and be restricted to a maximum of 0.012 weight % for sulfur and 0.015 weight % for phosphorus. All the other residual tramp elements including antimony, arsenic, lead, etc. should be as low as is practically feasible.

Gases such as nitrogen, oxygen and hydrogen either dissolved or precipitated in the steel, tend to degrade the steel's mechanical properties. In this regard, some nitrogen can actually be desirable if precipitated out in the form of stable carbonitrides for grain refining as stated previously. However, unstabilized or free nitrogen dissolved in steel has been found to be detrimental to the toughness both in the base steel as well as in the weld HAZ. For this reason, an upper limit of about 150 weight parts per million (wppm) is specified for soluble nitrogen for the steels of the present invention. More preferably, the amount of nitrogen should be as low as possible such as in the range of less than about 70–80 wppm. The oxygen and hydrogen levels should also be as low as is practical.

(IV) Control of Minor Alloying For Processing And Engineering Property Advantage As already indicated, the steels of the present invention are based on an integrated design approach to optimize the base mechanical and environmental properties while at the same time controlling the minor alloying ingredients so as to impart some unique processing and performance advantages compared to the state-of-the-art low alloy steels so that they exceed the competition and set new standards for performance in several practical requirements. These improvements are achieved without compromising the base or core properties. Some of these unique aspects of the steels of the present invention are described below.

The titanium-niobium co-additions, besides inducing the formation of a desirable fine grain structure in the steel, are also advantageous in restraining grain coarsening during the intense heat that prevails during the welding thermal cycle in the HAZ. However, if the total amount of these additions are not judiciously controlled, they can actually degrade the HAZ toughness in two important aspects: 1) formation of dislocation nucleated needle type precipitates, and 2) promotion of high carbon twinned martensite or martensite-austenite constituent in certain regions of HAZ. It has been found that the total addition of these elements should be restricted to less than about 0.05 weight % to minimize their deleterious effects on HAZ toughness. At these restricted amounts, the steels derive their beneficial effects on grain refining and stabilization of free nitrogen without the detrimental side effects on HAZ toughness.

The copper-nickel microalloying is found to be by far the most desirable alloying from the point of view of minimizing the adverse effects of any alloying in lowering the HAZ toughness brought about by its effect on increasing the hardenability of the steel.

The required copper additions of the steels of the present invention have been found to have some very interesting and desirable environmental resistance and practical fabrication benefits. The copper in steels of the present invention is found to increase the resistance of these steels to atmospheric corrosion and corrosion in sour environments, a property that is not readily available in the steels of the prior art. The increased corrosion resistance decreases the generation and absorption in the steel of atomic hydrogen, an extremely damaging by-product of the corrosion process. The decreased hydrogen is hypothesized to be responsible for the steels resistance to hydrogen-induced-cracking (HIC) in sour service. This special property is also desirable from the point of view of reducing the cold cracking susceptibility during welding. The beneficial side effect of copper on corrosion, together with its primary beneficial effect on the optimized mechanical stability of retained austenite in the microstructure, are hypothesized to confer on these steels some unique stress corrosion cracking resistance (SCC). In SCC, both the generation and transport of hydrogen are important as most mechanisms of SCC are based on hydrogen assisted cracking (HAC). Copper, by reducing the generation of hydrogen as the by-product of corrosion and by stabilizing the retained austenite against premature transformation, provides an ideal microstructure to resist hydrogen transport to regions where it can damage the material.

The restrictions on the silicon level in the steel are conducive to avoiding the formation of brittle, high carbon twinned martensite and/or martensite-austenite constituents in certain regions of HAZ. This allows the use of high welding heat inputs for welding, a production and fabrication flexibility, without undue penalty on HAZ toughness.

Several tests have been conducted which demonstrate the markedly improved combination of properties obtainable using the novel inventive concepts set forth hereinbefore.

EXAMPLE 1

A 25 kg melt was prepared by vacuum melting having the following composition:

| Element | Wt. % |
|---|---|
| C | 0.23 |
| Mn | 1.49 |
| Cr | 1.98 |
| Ni | 0.22 |
| Cu | 0.35 |
| Al | 0.020 |
| Ti | 0.014 |
| Nb | 0.012 |
| P | 0.008 |
| S | 0.002 |
| Si | 0.03 |
| N | 40 ppm |

Ingots were cast, homogenized in the conventional manner followed by forging into slabs. Test samples were cut from the forged slabs.

One group of test samples was subjected to Heat Treatment A which comprised austenitizing the steel at 900° C. for 45 minutes and rapidly quenched in water and the following mechanical properties obtained at room temperature.

| Heat Treatment A | |
|---|---|
| Hardness: | 48.5 Rockwell C. (RC) |
| Yield Strength: | 161,400 psi (1,112 MPa) |
| Ultimate Tensile Strength: | 238,390 psi (1,643 MPa) |
| % Reduction In Area*: | 36 |
| Charpy-V-Notch Impact Toughness: | 37.8 ft.lbs. (51.3 Joules) |

*test specimen had a diameter of 0.25 inch and a gage length of 1 inch.

Specimens were also subjected to Heat Treatment B. The specimens were austenitized at 900° C. for 45 minutes, rapidly quenched in water and then tempered for one hour at 225° C. and the following mechanical properties obtained at room temperature.

| Heat Treatment B | |
|---|---|
| Hardness: | 45.4 Rockwell C. (RC) |
| Yield Strength: | 175,000 psi (1207 MPa) |
| Ultimate Tensile Strength: | 215,000 psi (1483 MPa) |
| % Reduction In Area: | 63.6 |
| Charpy-V-Notch Impact Toughness: | 64 ft.lbs. (86.8 Joules) |
| Plane Strain Fracture Toughness $K_{IC}$: [By the Equivalent Energy Method] | 208.9 KSi-in$^{\frac{1}{2}}$ [231.9 MPa-in$^{\frac{1}{2}}$] |
| Mechanical Properties (at −40° C.) | |
| Hardness: | 46.2 Rockwell C. (RC) |
| Charpy-V-Notch Impact Toughness: | 32 ft.lbs. (43.4 Joules) |
| **Heat Treatment E** | |
| Austenitize at 900° C. for 45 minutes and rapidly quenched in water | |
| Temper for one hour at 200° C. and quenched in water | |
| Mechanical Properties at Room Temperature | |
| Hardness: | 46.6 Rockwell C. (RC) |
| Charpy-V-Notch Impact Toughness: | 54.6 ft.lbs. (74 Joules) |
| Mechanical Properties (at −40° C.) | |
| Hardness: | 47.0 Rockwell C. (RC) |
| Charpy-V-Notch Impact Toughness: | 40.2 ft.lbs. (54.5 Joules) |

As illustrative of improved results obtained with production sized heats, the following example is given.

EXAMPLE 2

The production sized heat had the following composition:

| Element | Wt. % |
|---|---|
| C | 0.21 |
| Mn | 1.55 |
| Cr | 1.93 |
| Ni | 0.26 |
| Cu | 0.32 |
| Al | 0.027 |
| Ti | 0.012 |
| Nb | 0.020 |
| P | 0.012 |
| S | 0.004 |
| Si | 0.10 |
| N | 125 ppm |

Heat Treatment A

Mechanical Properties at Room Temperature

| | |
|---|---|
| Hardness: | 47.8 Rockwell C. (RC) |
| Yield Strength: | 170,423 psi (1,174 Mpa) |
| Ultimate Tensile Strength: | 244,206 psi (1,683 MPa) |
| % Reduction In Area: | 54.5 |
| Charpy-V-Notch Impact Toughness: | 11.0 ft.lbs. (14.9 Joules) |

Mechanical Properties (at −40° C.)

| | |
|---|---|
| Charpy-V-Notch Impact Toughness: | 9.2 ft.lbs. (12.5 Joules) |

Heat Treatment B

Mechanical Properties at Room Temperature

| | |
|---|---|
| Hardness: | 43.2 Rockwell C. (RC) |
| Yield Strength: | 175,435 psi (1,209 MPa) |
| Ultimate Tensile Strength: | 212,527 psi (1,464 MPa) |
| % Reduction In Area: | 60.7 |
| Charpy-V-Notch Impact Toughness: | 38.4 ft.lbs. (52.1 Joules) |

Heat Treatment F

The specimen was austenitized at 1000° C. for 45 minutes and rapidly quenched in water.

| | |
|---|---|
| Hardness: | 47.3 Rockwell C. (RC) |
| Charpy-V-Notch Impact Toughness: | 28.4 ft.lbs. (38.5 Joules) |

Heat Treatment G

This specimen was austenitized at 1000° C. (45 minutes) and rapidly quenched in water and tempered for one hour at 225° C.

Mechanical Properties at Room Temoerature

| | |
|---|---|
| Hardness: | 43.6 Rockwell C. (RC) |
| Charpy-V-Notch Impact Toughness: | 46.5 ft.lbs. (63.1 Joules) |

Heat Treatment H

The specimen was austenitized at 1000° C. for 45 minutes and rapidly quenched in water and tempered for one hour at 200° C.

Mechanical Properties at Room Temperature

| | |
|---|---|
| Hardness: | 44.5 Rockwell C. (RC) |
| Charpy-V-Notch Impact Toughness: | 54.7 ft.lbs. (74.2 Joules) |

As will be noted, the lower tempering temperature of 200° C. improves the toughness of the steel with a slight rise in hardness.

Heat Treatment I

The specimen was austenitized at 1000° C. for 45 minutes, rapidly quenched in water and then tempered for one hour at a still lower temperature of 190° C.

Mechanical Properties at Room Temperature

| | |
|---|---|
| Hardness: | 45.0 Rockwell C. (RC) |
| Charpy-V-Noteh Impact Toughness: | 58.6 ft.lbs. (79.5 Joules) |

Lowering the tempering temperature to 190° C. further improved the toughness.

EXAMPLE 3

Another laboratory heat was produced by vacuum melting having the following composition:

| Element | Wt. % |
|---|---|
| C | 0.3 |
| Mn | 1.31 |
| Cr | 2.07 |
| Ni | 0.97 |
| Cu | 1.26 |
| Al | 0.004 |
| Ti | 0.008 |
| Nb | 0.017 |
| P | 0.005 |
| S | 0.003 |
| Si | 0.07 |
| N | 29 ppm |

Heat Treatment A

Mechanical Properties at Room Temperature

| | |
|---|---|
| Hardness: | 50.4 Rockwell C. (RC) |
| Yield Strength: | 175,435 psi (1,208 MPa) |
| Ultimate Tensile Strength: | 270,070 psi (1,861 MPa) |
| % Reduction In Area: | 28.4 |
| Charpy-V-Notch Impact Toughness: | 21.4 ft.lbs. (29 Joules) |

Heat Treatment B

Mechanical Properties at Room Temperature

| | |
|---|---|
| Hardness: | 45.6 Rockwell C. (RC) |
| Charpy-V-Notch Impact Toughness: | 34 ft.lbs. (46.1 Joules) |

In summary, the invention provides a high strength, low alloy, low to medium carbon steel consisting essentially of about 0.5 to 4% Cr, about 0.05 to 0.5% C, about 0.5 to 2% Mn, about 0.1 to 2% Cu, 0.1 to 3% Ni, about 0.01 to 0.05% Al, about 0.005 to 0.02% Ti, about 0.005 to 0.03% Nb and the balance essentially iron, said steel in the hardened condition being characterized by an amount of retained austenite ranging from about 1 to 10 volume % and generally from about 1 to 5 volume %.

The in the hardened state is characterized by a microstructure of lath martensite surrounded by a layer of retained austenite.

By controlling the composition of the steel within the range stated hereinabove, the austenite is characterized by mechanical stability when subjected to deformation working.

Although the present invention has been described in conjunction with the preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A fine grained, high strength, tough, low alloy, low to medium carbon wrought steel having an ultimate tensile strength of about at least 200 ksi, said steel having a microstructure in which soft and tough austenite films surround lath martensite, and consisting essentially by weight of about 0.5 to 4% Cr, about 0.05 to 0.5% C, about 0.5 to 2% Mn, about 0.1 to 2% Cu, about 0.1 to 3% Ni, about 0.01 to 0.05% Al, about 0.005 to 0.02% Ti, about 0.005 to 0.03% Nb and the balance essentially iron including minor amounts of tramp elements P, S, Si, and N, the amount of Si not exceeding about 0.1%, said steel being characterized by an average grain size of less than about 50 microns.

2. The fine grained steel as in claim 1, wherein said average grain size is less than about 25 microns.

3. The fine grained, high strength steel as in claim 1, wherein the amount of P does not exceed about 0.015%, the amount of S does not exceed about 0.012%, the amount of Si does not exceed about 0.1%, and the amount of N does not exceed about 150 ppm.

4. As an article of manufacture, a fine grained wrought steel component comprised of a high strength at least 200 ksi, low alloy, low to medium carbon steel, said steel having a microstructure in which soft and tough austenite films surround lath matensite, and consisting essentially by weight of about 0.5 to 4% Cr, about 0.05 to 0.5% C, about 0.5 to 2% Mn, about 0.1 to 2% Cu, about 0.1 to 3% Ni, about 0.01 to 0.05% Al, about 0.005 to 0.02% Ti, and about 0.005 to 0.03% Nb, and the balance being essentially iron containing minor amounts of tramp elements P, S, Si, and N, the amount of Si not exceeding about 0.1%, said steel being characterized by a fine average grain size of less than about 50 microns.

5. The fine grained steel component as in claim 4, wherein the average grain size is less than about 25 microns.

6. The article of manufacture of claim 4, wherein the amount of P does not exceed about 0.015%, the amount of S does not exceed about 0.012%, the amount of Si does not exceed about 0.1%, and the amount of N does not exceed about 150 ppm.

7. The article of manufacture of claim 4, wherein said low alloy steel contains about 0.1 to 1% Cu, about 0.1 to 1% Ni, and wherein the amount of said retained austenite ranges from about 1 to 10 volume % of said steel.

8. The article of manufacture as in claim 7, wherein the amount of austenite in said low alloy steel ranges from about 1 to 5% by volume.

9. A fine grained, high strength, tough, low alloy, low to medium carbon wrought steel in the hardened condition having an ultimate tensile strength of about at least 200 ksi, said steel having a microstructure in which soft and tough austenite films surround lath martensite, and consisting essentially by weight of about 0.5 to 4% Cr, about 0.05 to 0.5% C, about 0.5 to 2% Mn, about 0.1 to 2% Cu, about 0.1 to 3% Ni, about 0.01 to 0.05% Al, about 0.005 to 0.02% Ti, about 0.005 to 0.03% Nb and the balance essentially iron including minor amounts of tramp elements P, S, Si, and N, the amount of Si not exceeding about 0.1%, said steel in the hardened condition being characterized by a microstructure of lath martensite surrounded by a layer of retained austenite.

10. The fine grained, high strength, hardened steel as in claim 9, wherein the amount of P does not exceed about 0.015%, the amount of S does not exceed about 0.012%, the amount of Si does not exceed about 0.1%, and the amount of N does not exceed about 150 ppm.

11. The fine grained, high strength hardened steel as in claim 10, wherein the amount of retained austenite in said steel ranges from about 1 to 10% of the volume of said steel.

12. The fine grained steel as in claim 11, wherein the amount of retained austenite ranges from about 1 to 5% by volume of said steel.

13. A fine grained, high strength, tough, low alloy, low to medium wrought carbon steel in the hardened condition having a ultimate tensile strength of about at least 200 ksi, said steel having a microstructure in which soft and tough austenite films surround lath martensite, and consisting essentially by weight of about 1.8 to 2.4% Cr, about 0.2 to 0.25% C, about 1.4 to 1.6% Mn, about 0.25 to 0.5% Cu, about 0.2 to 0.5% Ni, about 0.02 to 0.05% Al, about 0.005 to 0.02% Ti, about 0.005 to 0.03% Nb and the balance being essentially iron including minor amounts of tramp elements P, S, Si, and N, the amount of Si not exceeding about 0.1%, said steel in the hardened state being characterized by a microstructure of lath martensite surrounded by a layer of retained austenite.

14. The fine grained, high strength, hardened steel as in claim 13, wherein the amount of P does not exceed about 0.015%, the amount of S does not exceed about 0.012%, the amount of Si does not exceed about 0.1%, and the amount of N does not exceed about 150 ppm.

15. The fine grained, high strength hardened steel as in claim 13, wherein the amount of retained austenite ranges from about 1 to 10% by volume of said steel.

16. The fine grained, high strength hardened steel as in claim 15, wherein the amount of retained austenite ranges from about 1 to 5% by volume of said steel.

* * * * *